US005242037A

United States Patent [19]

Stjärne

[11] Patent Number: 5,242,037

[45] Date of Patent: Sep. 7, 1993

[54] RAIL VEHICLE BRAKE ACTUATOR WITH A BRAKE BLOCK HOLDER

[75] Inventor: Anders O. G. Stjärne, Löddeköpinge, Sweden

[73] Assignee: SAB Wabco Holdings B.V., Sweden

[21] Appl. No.: 848,097

[22] Filed: Mar. 9, 1992

[30] Foreign Application Priority Data

Mar. 11, 1991 [SE] Sweden ..... 9100718-7

[51] Int. Cl.[5] ..... B61H 13/24

[52] U.S. Cl. ..... 188/206 R; 188/153 R; 267/160

[58] Field of Search ..... 188/206 R, 205 R, 33, 188/153 R, 51-55, 209, 207, 212, 74; 267/160, 158, 30

[56] References Cited

U.S. PATENT DOCUMENTS

| | | | |
|---|---|---|---|
| 2,820,625 | 1/1958 | Davis | 267/158 |
| 3,062,328 | 11/1962 | Butler | 188/33 |
| 3,727,900 | 4/1973 | Casey | 267/160 |
| 4,406,444 | 9/1983 | Bogenschutz | 267/160 X |
| 4,630,714 | 12/1986 | Stjärne et al. | 188/153 R X |

*Primary Examiner*—Robert J. Oberleitner
*Assistant Examiner*—Peter M. Poon
*Attorney, Agent, or Firm*—Laurence R. Brown

[57] ABSTRACT

A rail vehicle brake actuator has a brake block holder (3) suspended therefrom (so as to be laterally movable during braking) by hangers (5) in the form of leaf springs. The hangers are rotatably attached to the lower end of the brake block holder by a stiff lower shaft (8) and to an actuator bracket (2) by pivot joints on a rotatable upper shaft (7).

2 Claims, 3 Drawing Sheets

RAIL VEHICLE BRAKE ACTUATOR WITH A BRAKE BLOCK HOLDER

TECHNICAL FIELD

This invention relates to a rail vehicle brake actuator with a brake block holder suspended therefrom so as to be laterally movable during braking, wherein hangers suspending the brake block holder consist of leaf springs rotatably attached to a bracket on the actuator and to the brake block holder, respectively.

BACKGROUND OF THE INVENTION

A block brake actuator, normally a so called brake unit containing a brake cylinder and a slack adjuster, can conventionally be provided with a brake block holder suspended therefrom. The suspension by hangers or links is such that the brake block holder (provided with a brake block) can move in the plane of the actuator push rod to and fro braking engagement with a wheel to be braked.

When the brake actuator is fixedly mounted in the vicinity of the wheel to be braked, only very limited axial movements of the wheel or wheel-set can be allowed.

In recent years there has been a clear tendency towards rail vehicle designs allowing greater axial movements of the wheel-sets. Certain ways of solving the problem with braking an axially movable wheel-set are known. Especially, when as preferred the brake actuator is fixedly mounted in the rail vehicle underframe or bogie in the vicinity of the wheel to be braked, a solution with leaf springs to suspend the brake block holder as set out above is known. Such a prior art solution, on which the present invention is based, is shown in U.S. Pat. NO. 4 630 714; reference is made to this prior art.

In this prior design, which per se was a successful break-through with extended commercial use, the brake block holder is suspended at its center by a stack of leaf springs at each side. The upper connection to the actuator bracket is only rotational, whereas the lower connection to the brake block holder center is rotational and pivotal to allow the brake block holder to remain vertical (for braking cooperation with a wheel tread) in spite of deflection of the hangers in the form of the leaf springs. Although it does not really appear from said publication, the design for obtaining this rotational and pivotal connection is quite complex. It has to be very well protected, because intrusion of moist and dirt to its intricate parts (for example spherical bearings) has to be avoided.

The Invention

A simpler design, which is easier to protect and still gives at least the same functional advantages as the prior design, is according to the invention attained in that the hangers are rotatably attached to the lower end of the brake block holder by means of a stiff lower shaft and that there is a pivot joint between each hanger and a rotatable upper shaft in the bracket.

By the fact that each hanger is attached to the lower end of the brake block holder it is so long that the necessary flexibility may be obtained by only one leaf spring instead of the previously necessary stack of leaf springs (containing for example four leaf springs).

In the former design the hangers in the form of leaf springs were prestressed in the direction for compensating for the bias of the taper of the wheel tread which it is intended to engage. This prestress was afforded by a flat bar extending along the major length of one of the hangers. According to a further aspect of the present invention this prestress in the hangers may be adjusted by means of a screw in the bar.

BRIEF DESCRIPTION OF THE DRAWINGS

The invention will be described in further detail below reference being made to the accompanying drawings in which.

DETAILED DESCRIPTION OF A PREFERRED EMBODIMENT

Figure 1:
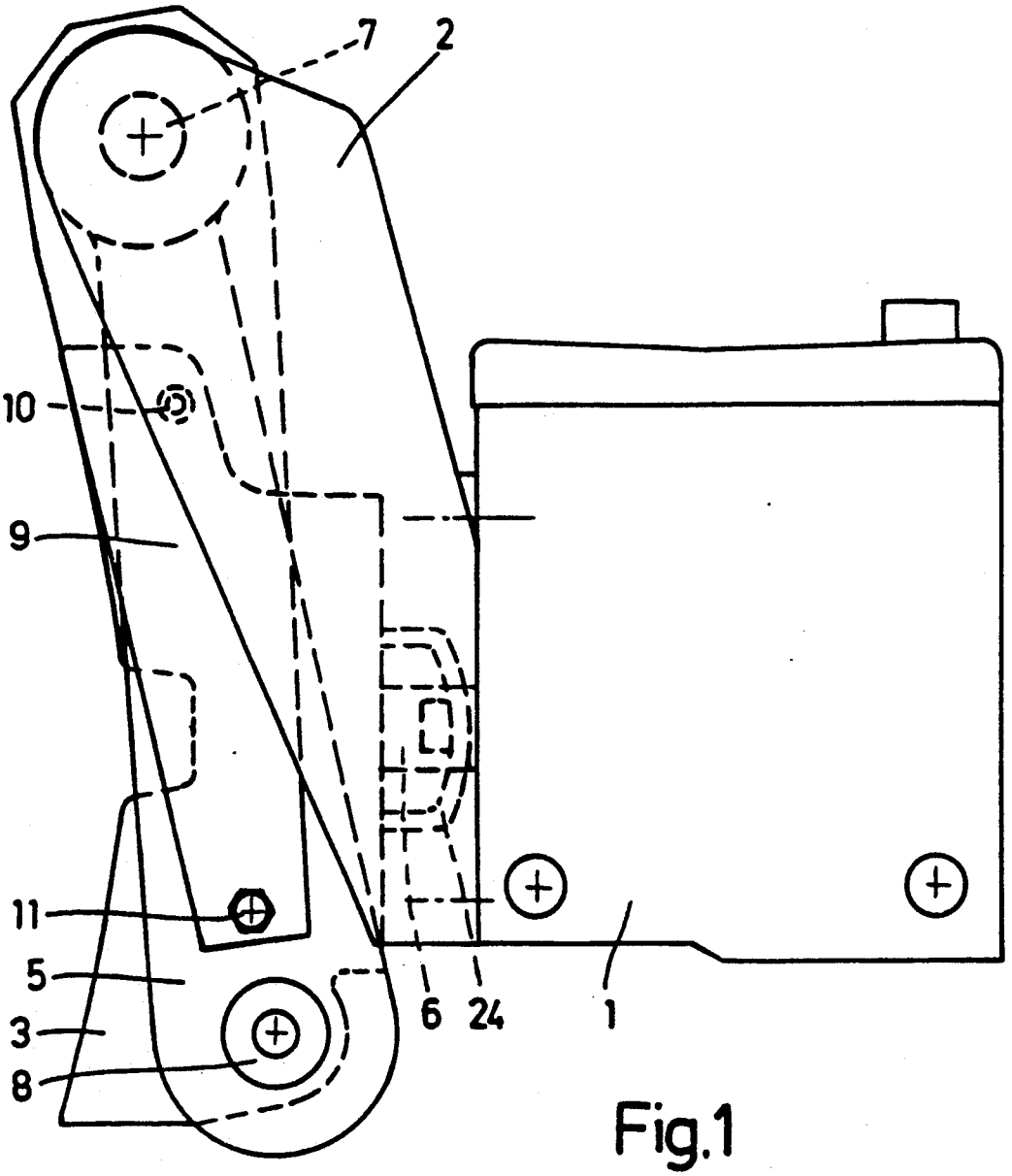
FIG. 1 is a side view of a rail vehicle brake unit with a brake block holder arrangement according to the invention.

A conventional brake actuator 1 forming no part of the present invention and normally including a brake cylinder and a slack adjuster (so as to form a brake unit) is provided with a mounting bracket 2 in the general form of an open-sided casing. The bracket is attached to the brake actuator 1 by means of screws (which are only indicated in FIG. 1).

Without going into details at this stage, a brake block holder 3 is suspended in two hangers 4, 5 rotatably attached to the bracket 2 at their respective upper ends and to the lowermost part of the brake block holder 3 at their lower ends. The brake block holder 3 is centrally actuated by an outgoing push rod 6 of the brake actuator 1.

Each hanger 4, 5 consists of one leaf spring and is thus deflectable. In a way to be described below the hangers are pivotally suspended from an upper shaft 7, which is rotatably mounted in the bracket 2. The hangers 4, 5 are connected at their lower ends by a lower shaft 8, on which the brake block holder 3 is rotatably mounted.

Figure 2:
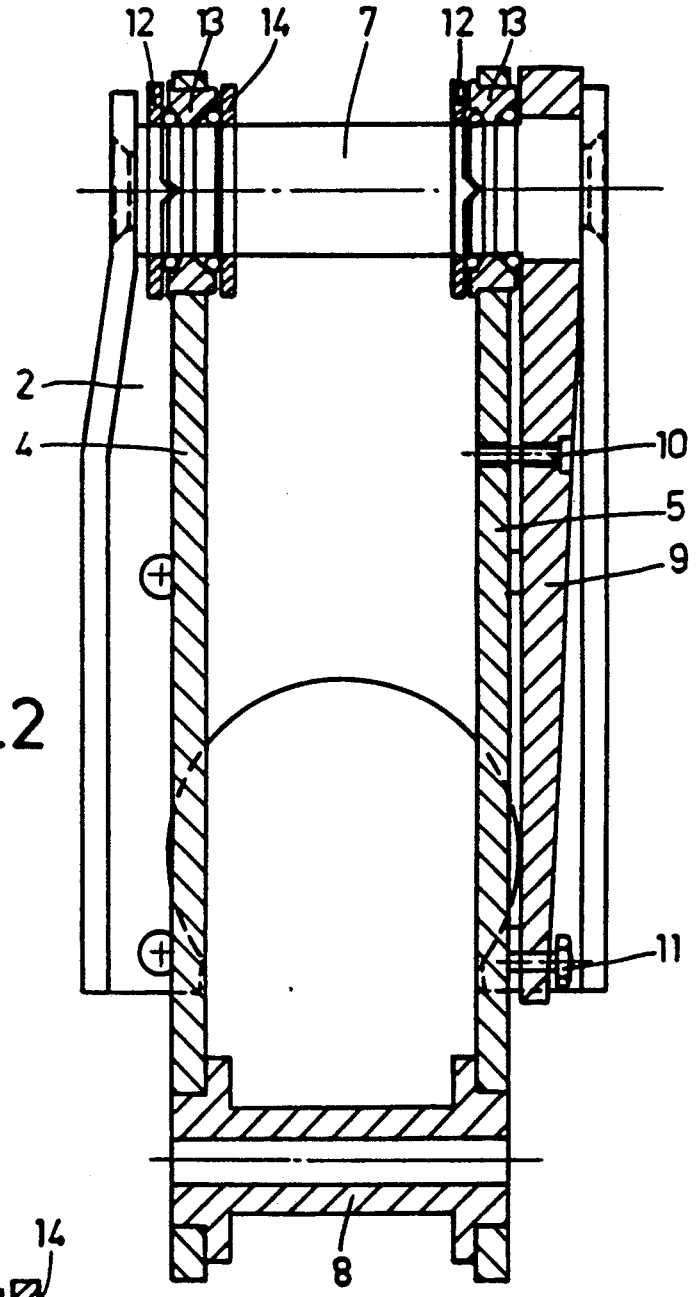
FIG. 2 is a partly sectional view from the left in FIG. 1 of only parts of the brake block holder arrangement (and with the brake block holder itself omitted)

Immediately to the right of the right hanger 5 in FIG. 2 there is a rigid flat bar 9, which is also arranged on the upper shaft 7. This flat bar 9 is arranged at the same side of the arrangement as the wheel flange of the wheel that the brake block attached to the brake block holder 3 is to brakingly cooperate with. The flat bar 9 limits the movements of the hangers 4, 5 to the right in FIG. 2, whereas they can deflect to the left, where there is space afforded by the bracket 2.

As the flat bar 9 is arranged at the wheel flange, a similar arrangement placed at the other side of the vehicle has to be inverted.

The right hanger 5 and the bar 9 are connected for rotational movements together by means of a pin 10. A screw 11 in the lower end of the bar 9 contacting the hanger 5 serves as a means for adjusting the prestress in the hanger 5 and also (by the shaft 8) the hanger 4. (A rest position for the hangers 4, 5 will of course hereby be defined.)

Figure 3:
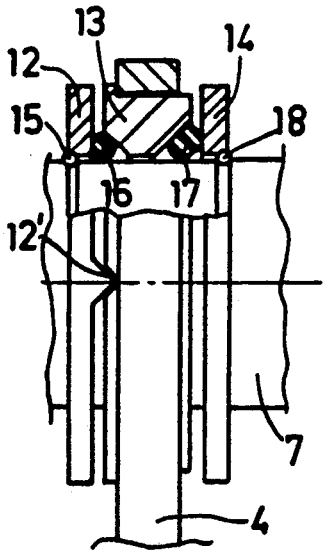
FIG. 3 is a detail view to a larger scale of the upper left hand part of FIG. 2.

The pivot joints between the hangers 4, 5 and the shaft 7 will now be described with reference to FIG. 2 but more particularly FIG. 3, which to a larger scale shows the joint between the left hanger 4 and the upper shaft 7.

The joint consists of the following main parts: a left support washer 12, a bushing 13 secured to the hanger 4, and a right support washer 14. This right washer 14 is lacking in the right joint for the hanger 5, where its function is taken over by the bar 9.

A locking ring 15 is arranged to the left of (or outside) the left support washer 12 in a circumferential groove in the shaft 7. The edges of the bushing 13 facing the shaft 7 are slanted as shown. A rubber O-ring 16 with somewhat smaller cross-sectional diameter is arranged at the left hand side of the bushing 13 and a rubber O-ring 17 with somewhat larger cross-sectional diameter at the right hand side of the bushing 13, where the slant is somewhat larger. The joint is held together by the right support washer 14 (only to the left in FIG. 2) and secured under prestress by a further locking ring 18 to the right of this washer 14.

The three elements 13, 16, 17 can alternatively be combined into one rubber ring.

The left hand support washer 12 is provided with an edge 12' cooperating with a corresponding recess in the bushing 13 so as to provide a pivot point for the hanger 4 (or the hanger 5 in the right joint).

The described joints will allow the hangers 4 and 5 to freely rotate or swing and pivot in the direction for applying a brake block on a wheel tread and in the direction for following a side-ways motion of the wheel to the left in FIG. 2. The joint is simple and comparatively cheap, but yet it is well protected.

Figure 5:
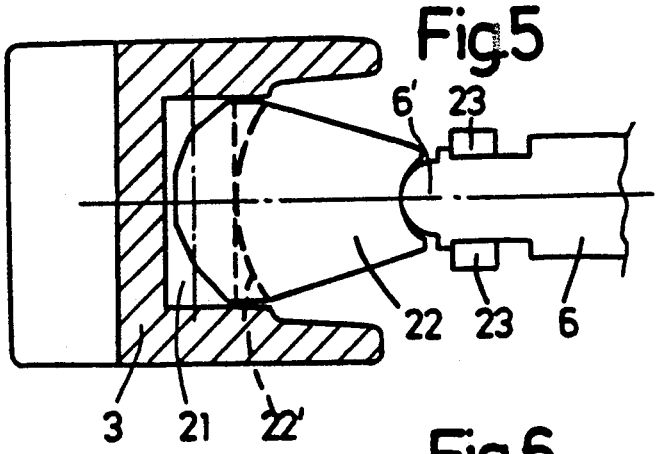
FIG. 5 is a view substantially along the line V—V in FIG. 4.
Figure 6:
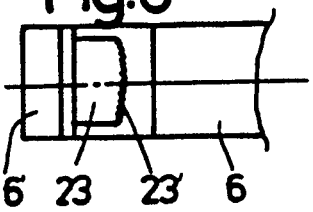
FIG. 6 is a side view of a brake unit push rod, also shown in FIGS. 4 and 5.
Figure 4:
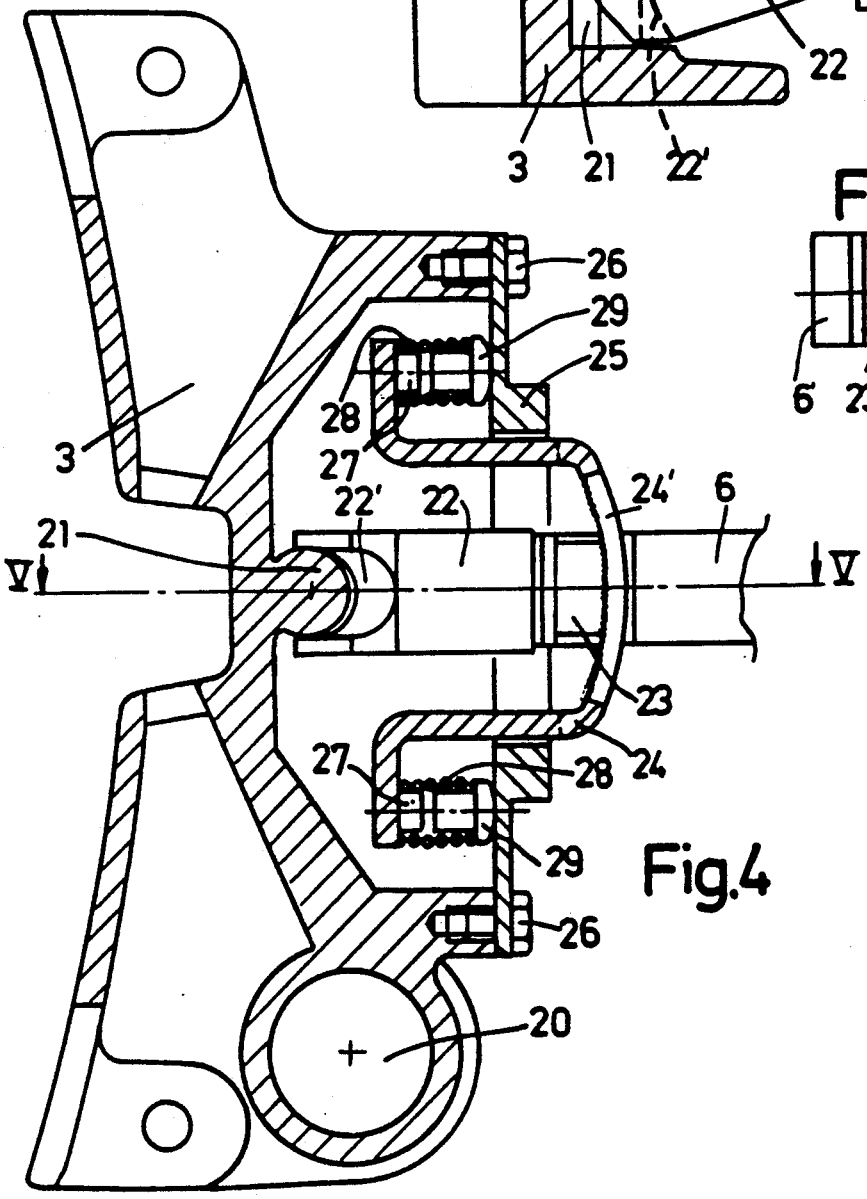
FIG. 4 is a partly sectional side view of the brake block holder in the arrangement shown in FIG. 1.

Reference is now made primarily to FIG. 4 but also FIGS. 5 and 6. FIG. 4 is a side view of the brake block holder 3, which has a through hole 20 at its lower end, for its rotatable mounting to the lower shaft 8 (FIG. 2). The brake block holder is designed to releasably receive a brake block (not shown) to the left in FIG. 4 for braking cooperation with the tread of a wheel.

From the description above it is clear that the brake block holder 3 is movable side-ways (i.e. perpendicularly to the plane of the drawing) under the influence of the axial movements of the wheel (or wheelset) during braking, but also that it will have an arcuate application movement about the shaft 7, from which the brake block hangers 4, 5 are suspended. The means transmitting the brake force from the stationary brake actuator 1 to the movable brake block holder 3 have to accommodate these movements. Further, means must be provided to keep the brake block holder 3 in a substantially vertical position but allow it to follow the movements of the wheel. The inventive means to accomplish all this shall now be described.

The solely axially movable push rod of the brake actuator 1 has the designation 6 and is to apply its push force centrally on the brake block holder, which for this purpose is provided with a transverse, cylindrical portion 21. A force transmitting member 22 is arranged between the push rod 6 and the cylindrical portion 21. The push rod 6 has a cylindrical end 6' perpendicular to the cylindrical portion 21, as appears from FIG. 5. The force transmitting member 22 has a cylindrical recess for cooperation with this push rod end 6'. As appears from FIG. 5, the maximum width of the force transmitting member 22, which tapers towards its end in contact with the push rod 6, corresponds to the internal width between the sidewalls of the brake block holder 3, which means that the member 22 is always guided irrespective of its angular position.

The left end of the force transmission member 22 cooperating with the cylindrical portion 21 has a cylindrical recess 22' with a radius corresponding to that of the portion 21. As appears both from FIG. 4 and FIG. 5 in two views, this cylindrical recess 22' has an arcuate shape with its center coinciding with the center for the cylindrical push rod end 6'. By this arrangement all the possible relative movements between the brake actuator push rod 6 and the brake block holder 3 may be accommodated with full brake force transmission capacity.

The push rod 6 is towards its end provided with a protrusion 23 at each side. Each protrusion 23 has a curved toothed side 23' facing from the push rod end 6'. Each such toothed side 23' cooperates with a correspondingly toothed surface on a leg 24' of a shackle 24 straddling the push rod 6. This shackle 24 extends through and receives guiding from a cover 25 attached to the back of the brake block holder 3 by means of screws 26.

At its two ends inside the cover 25 the shackle 24 is provided with knobs 27 for compression springs 28 on studs 29 supported by the cover 25. By means of this spring-biassed shackle 24 the brake block holder 3 will be held in a substantially vertical position or the position given it at the latest brake application, but the brake block holder 3 will be free enough to adopt the position forced upon it by the wheel with which its brake block cooperates. The shackle 24 also keeps the force transmitting parts 6, 22 and 21 together at all times.

The distance between each knob 27 and stud 29 is relatively small, so that undesired movements of the push rod 6, for example at manual resetting of the slack adjuster in the brake actuator 1, are prevented.

The same distance and the distance or play between the shackle 24 and the cover 25 will have the result that the brake block holder 3 can accommodate smaller wheel movements during braking without adjustments of the relative positions of the elements 23 and 24', so that unnecessary wear of the toothed surfaces is avoided. Also a dampening effect on external vibrations is attained.

By means of the arrangement with the shackle 24 such a connection between the brake actuator 1 and the brake block holder 3 is obtained that no separate return spring for the latter is normally required.

I claim:

1. A rail vehicle braking system, comprising in combination, a brake actuator (1), a brake block holder (3) having a lower end suspended from the actuator so as to be laterally movable during braking, hangers (4, 5) suspending the brake block holder comprising leaf springs, a bracket (2), suspension means rotatably attaching the hangers (4, 5) to the bracket (2) on the actuator comprising a rotatable upper shaft (7), coupling means between the hangers and the brake block holder at said lower end, the hangers (4, 5) being rotatably attached to the lower end of the brake block holder (3) by a stiff lower shaft (8) disposed between the hangers (4, 5), and a pivot joint (12–17) between each hanger and the rotatable upper shaft (7) in the bracket (2) comprising a member about the upper shaft (7) with a pivot point (12') engaging at least one of the hangers substantially in alignment with a pivot axis of rotation of the hangers about the bracket (2) and flexible structure (13, 16, 17) disposed about shaft (7) for engaging said hangers to accommodate lateral pivoting of the hangers in a lateral movement direction following axial movement of the wheels being braked.

2. An actuator according to claim 1, further comprising means for prestressing the hangers (4, 5) in the form of leaf springs in a direction for compensating for the bias of the taper of a wheel tread to be engaged, including a flat bar (9) arranged at one of the hangers along the major length thereof and a screw (11) mounted at lower end of the bar (9) to contact and bias the leaf near the lower shaft (8) for variably adjusting the prestress.

* * * * *